US006031168A

United States Patent [19]

Damm

[11] Patent Number: 6,031,168

[45] Date of Patent: Feb. 29, 2000

[54] PRACTICE BAGPIPE CHANTER

[76] Inventor: Edward A. Damm, 24 Ledgelawn Ave., Bar Harbor, Me. 04609

[21] Appl. No.: 09/207,308

[22] Filed: Dec. 8, 1998

[51] Int. Cl.[7] ..... G10D 7/00

[52] U.S. Cl. ..... 84/380 B; 84/380 R; 84/465

[58] Field of Search ..... 84/380 A, 380 B, 84/380 R, 381, 380 C, 465, 453; D17/10

[56] References Cited

U.S. PATENT DOCUMENTS

| | | | |
|---|---|---|---|
| 152,554 | 6/1874 | Gade | 84/380 R |
| D. 248,187 | 6/1978 | Roe | D17/2 |
| 1,069,200 | 8/1913 | Starck | 84/380 B |
| 1,498,280 | 6/1924 | Izold | 84/380 R |
| 2,233,507 | 3/1941 | Adamson | 84/380 B |
| 2,509,429 | 5/1950 | Grow | 84/380 B |
| 2,737,074 | 3/1956 | Magnus | 84/375 |
| 3,154,995 | 11/1964 | Kuhn | 84/381 |
| 3,438,298 | 4/1969 | Thompson | 84/380 R |
| 3,756,112 | 9/1973 | Adams | 84/380 B |
| 3,988,956 | 11/1976 | Moeck | 84/380 R |
| 4,104,948 | 8/1978 | Young | 84/380 C |
| 4,306,484 | 12/1981 | Toyama | 84/380 R |
| 4,378,724 | 4/1983 | Lamart | 84/465 |
| 4,539,888 | 9/1985 | Whelan | 84/380 R |

FOREIGN PATENT DOCUMENTS

| | | |
|---|---|---|
| 16300 | 7/1916 | United Kingdom . |
| 1582404 | 1/1981 | United Kingdom . |

OTHER PUBLICATIONS

Baines, A.: "Woodwind Instruments and their History.," (2nd edition), William Clowes and Sons, LTD, London, 1962, p. 200.

Encyclopedia Britannica, (15th edition), Encyclopedia Britannica, Inc., 1994, p. 795.

Dearling, R. (ed): "The Illustrated Encyclopedia of Musical Instruments." Carlton Books LTD, Dubai, 1996, pp. 185 and 187.

*Primary Examiner*—David Martin
*Assistant Examiner*—Wesley Scott Ashton
*Attorney, Agent, or Firm*—Michael J. Pebson; William B. Ritchie

[57] ABSTRACT

The present invention is a practice chanter for simulating a bagpipe chanter. In its most basic form, the practice chanter of the present invention includes a flexible airtube, a fipple head attached to the flexible airtube, and a rigid whistle tube attached to the fipple head. In this basic embodiment, the whistle tube includes a plurality of holes disposed at predetermined locations along the length of the whistle tube corresponding to locations of holes in the predetermined bagpipe chanter, with each of the holes having a predetermined diameter such that the key and pitch of notes produced by the practice chanter correspond to notes produced by the bagpipe chanter. In the preferred embodiment, the practice chanter is dimensioned to simulate an Uilleann Pipe chanter. In this embodiment, the whistle tube holes are disposed in the same relation to one another as with an Uilleann Pipe chanter and each hole is of a predetermined diameter that allows notes played by the practice chanter with a given fingering pattern to correspond to notes produced by the Uilleann Pipe chanter played with the same fingering pattern.

17 Claims, 8 Drawing Sheets

PRACTICE BAGPIPE CHANTER

FIELD OF THE INVENTION

The present invention relates to the field of musical practice aids and, in particular, to practice chanters for Uilleann Pipes.

BACKGROUND OF THE INVENTION

Bagpipes have been played since Roman times and, despite their common connotation as purely Scottish instruments, are widely played in other parts of Europe, Asia, North America and North Africa. Bagpipes are reed instruments characterized by an air reservoir in the form of a bag that is inflated by air from a player's mouth or by bellows operated by the player's arm. The bag is usually made of an animal skin into which the chanter, or fingered melody pipe, and the unfingered drone pipes are inserted. The chanter and drones may be either cylindrical or conical, and have a single or double reed at their upper ends where they fit into the bag. Because the reeds are supplied with air from the bag, and not directly from the player's mouth, the player may breathe while playing resulting in an uninterrupted sound.

One type of bagpipe is the Uilleann Pipe, whose name derives from the Irish word meaning elbow. Uilleann Pipes typically utilize a bellows placed under one arm that inflates a bag placed under the other arm. A typical Uilleann Pipe includes a fingered reeded chanter drilled with eight holes, up to three reeded drone pipes and up to three keyed regulators. However, some chromatic Uilleann Pipe chanters may include four more keyed holes. While playing, the chanter is held such that the end of the chanter rests against the leg of the player. In this manner, the player simultaneously fills the bag with air from the bellows, pumps air from the bag through the chanter and drone pipes and manipulates the fingers over the eight holes of the chanter to produce sounds.

The Uilleann Pipes have been played in the United States for many years, but have gained popularity of late due to their use in the soundtrack for the movie "Titanic" and in the stage production of "Riverdance". However, many people wishing to learn to play the Uilleann Pipes are discouraged from doing so by their price and availability, which range from between $2,000 and $6,500 and between 2 and 6 years to obtain a new set. As a result, there has been a need for "practice" sets of Uilleann Pipes that are readily available and reasonably priced.

Currently, there are a number of practice sets of Uilleann Pipes on the market that include a reeded chanter a bellows and bag, but do not include drone pipes. These sets allow a player to practice the coordination between bellows and bag and to practice the fingering of the chanter. However, the cost of these "practice" pipes is still between $700 and $1,300, due to the high cost of the bellows and bag. Thus, even practice pipes may be too expensive for a person who is interested in learning to play, but is unsure of whether they will continue to play.

To eliminate the cost of the bag and bellows, practice chanters for other types of bagpipes have been developed utilizing a modified tin whistle design. The tin whistle belongs to the species of musical instrument called flageolets. The terms "whistle flute" and "fipple flute" are used to designate flageolets and refer to a method of sound production. The fipple is an apparatus formed by a small plug or block, usually wood, set into a mouthpiece or formed integral to the mouthpiece. A small space or duct is created between the edge of the fipple and the inside wall of the instrument. In operation, the airstream from the player is directed by this fipple duct system against a sharp edge or lip that is cut into the tube below the fipple, thereby producing sound. Practice chanters for Great Highland Bagpipes, such as those sold under the trade name "Chanter Whistle" by Piper Mike of Lake Mary, Fla., are modified tin whistles in that they utilize a fipple head formed into a tube. By modifying such a whistle to include the finger locations of those on a Great Highland Bagpipe chanter, the fingering of the Great Highland Bagpipes could be practiced without investing in a complete set of pipes. However, this chanter falls short as the notes produced by the device were off pitch from those needed to simulate those produced by a normal Great Highland Bagpipe practice chanter, which would use a reed, when played with the same fingerings. Further, the amount of air required to achieve a given note is opposite of what is required of the actual Great Highland Bagpipes or it's normal practice chanters; i.e. the Piper Mike Chanter Whistle would require the least amount of air for its highest note while the highest note on the actual bagpipe would require the largest amount of air.

A practice chanter for the Uilleann Pipes that is reasonably priced, readily available and that produces notes that simulate the fingering and the sounds produced by a chanter on a full set of Uilleann Pipes is not known in the art.

SUMMARY OF THE INVENTION

The present invention is a practice chanter for simulating a bagpipe chanter. In its most basic form, the practice chanter of the present invention includes a flexible airtube, a fipple head attached to the airtube, and a rigid whistle tube attached to the fipple head. In this basic embodiment, the whistle tube includes a plurality of holes disposed at predetermined locations along the length of the whistle tube corresponding to locations of holes in the predetermined bagpipe chanter, with each of the holes having a predetermined diameter such that the key and pitch of notes produced by the practice chanter correspond to notes produced by the bagpipe chanter. In the preferred embodiment, the practice chanter is dimensioned to simulate an Uilleann Pipe chanter. In this embodiment, the whistle tube holes are disposed in the same relation to one another as with an Uilleann Pipe chanter and each hole is of a predetermined diameter that allows notes played by the practice chanter with a given fingering pattern to correspond to notes produced by the Uilleann Pipe chanter played with the same fingering pattern. In the preferred embodiment, the flexible airtube is manufactured from a clear vinyl tubing to allow a player to monitor buildup of water vapor within the tube. In one embodiment of the invention, each of the holes is of a predetermined diameter and is disposed at a predetermined location such that the practice chanter plays in a B flat key and in another embodiment in a key of A.

Therefore, it is an aspect of the invention to provide a practice chanter for Uilleann Pipes that is reasonably priced.

It is a further aspect of the invention to provide a practice chanter for Uilleann Pipes that is readily available.

It is a further aspect of the invention to provide a practice chanter for Uilleann Pipes that produces notes that simulate the sounds produced by a chanter on a full set of Uilleann Pipes.

It is a still further aspect of the invention to provide a practice chanter for Uilleann Pipes that may be adapted to play in a number of different keys.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE DRAWINGS

Figure 1:
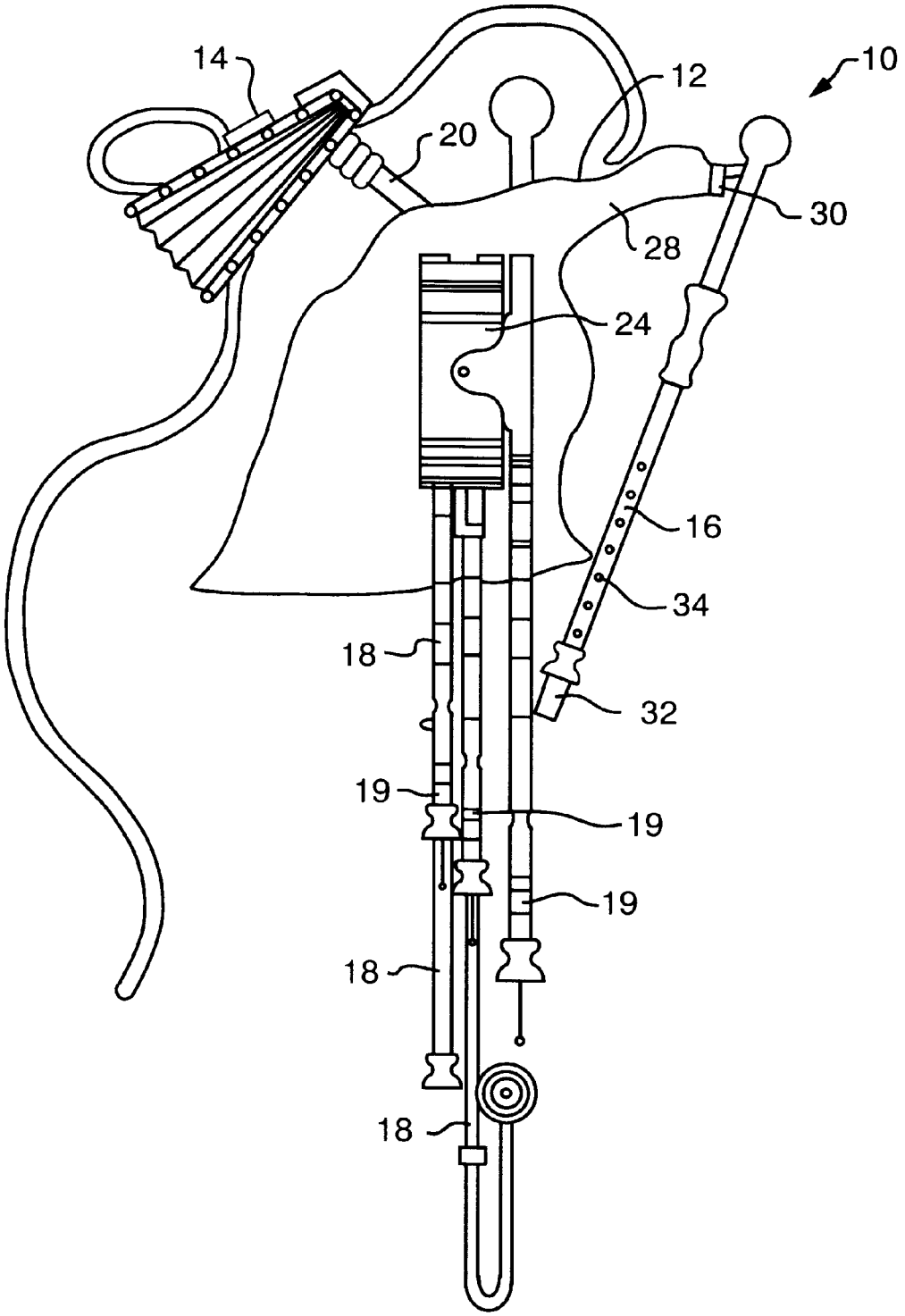
FIG. 1 (PRIOR ART)
FIG. 1 is an isometric view of a set of prior art Uilleann Pipes having a bellows, bag, chanter and drone pipes.

Referring first to FIG. 1, a schematic view of a full set of prior art Uilleann Pipes is shown. Uilleann Pipes 10 comprise a bag 12, bellows 14, chanter 16, three drone pipes 18 and three regulators 19. Bag 12 is substantially flexible and is attached to bellows 14 by blowpipe 20. Air is pumped from bellows 14 into bag 12 and out through chanter 16 and drone stock 24. Drone pipes 18 are reeded tubes extend from a main drone stock 24. Chanter 16 is attached to a neck 28 of bag 12 via a chanter stock 30 and includes a plurality of holes 34 disposed at predetermined positions along its length and an open end 32.

Figure 2:
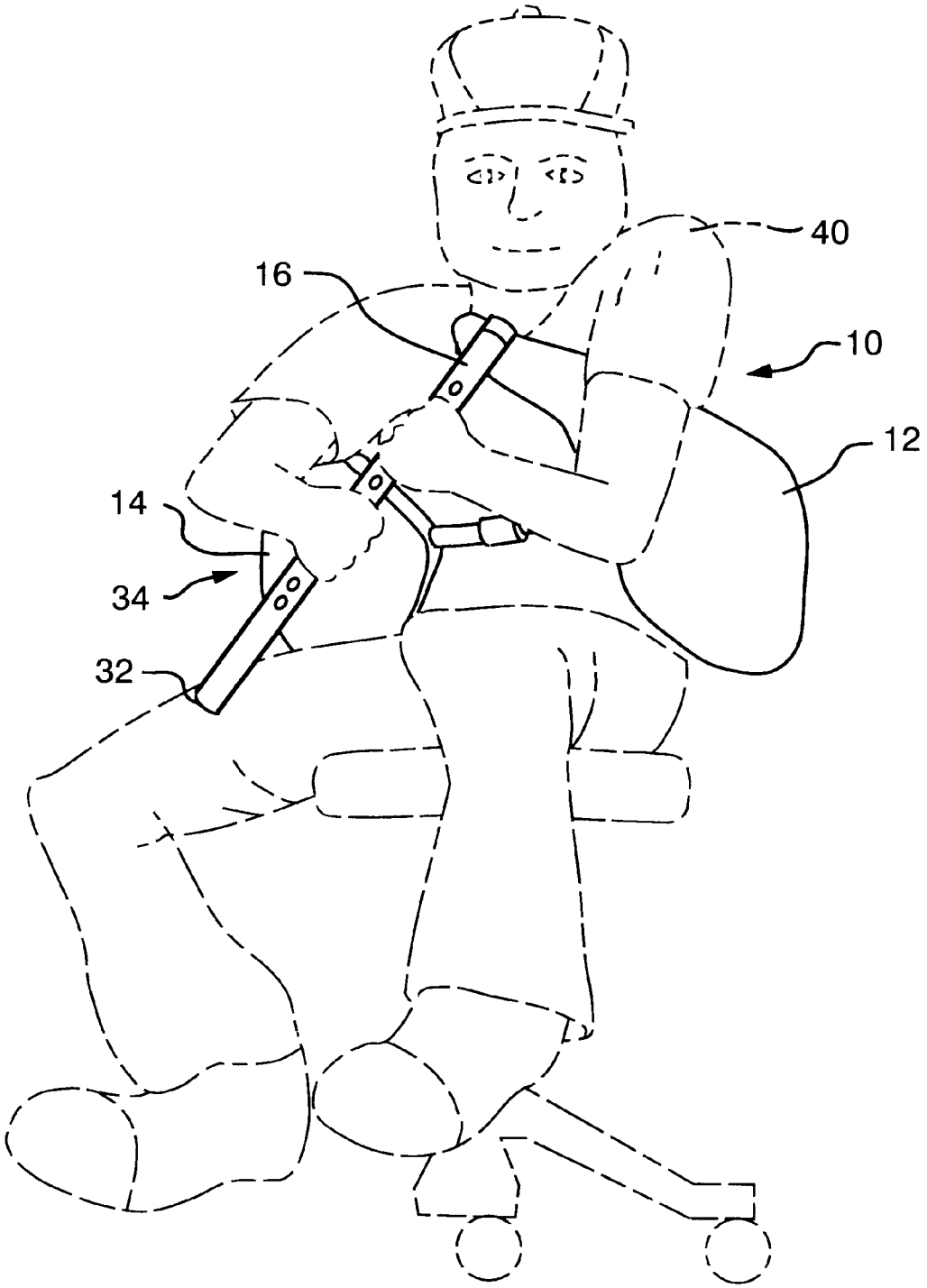
FIG. 2 (PRIOR ART)
FIG. 2 is an isometric view of a person playing a set prior art Uilleann Pipes with drone pipes removed for clarity.

Referring now to FIG. 2, an isometric view of a person playing a prior art Uilleann Pipe is shown, with drones and regulators removed for clarity. Uilleann Pipes 10 are generally played in the closed position meaning that the fingers of the player 40 cover all of the holes 34 of the chanter 16 and the open end 32 of the chanter 16 is pressed against the leg of the player 40. As this is the case, Uilleann Pipes 10 are generally played in a sitting position to allow the open end 32 of the chanter 16 be properly placed. In operation, a right handed player 40 places the bag 12 under the left arm and the bellows 14 under the right arm and pumps each while uncovering the desired holes 34 and covering and uncovering the open end 32 of the chanter 16 from the leg to play the desired notes.

Figure 3:
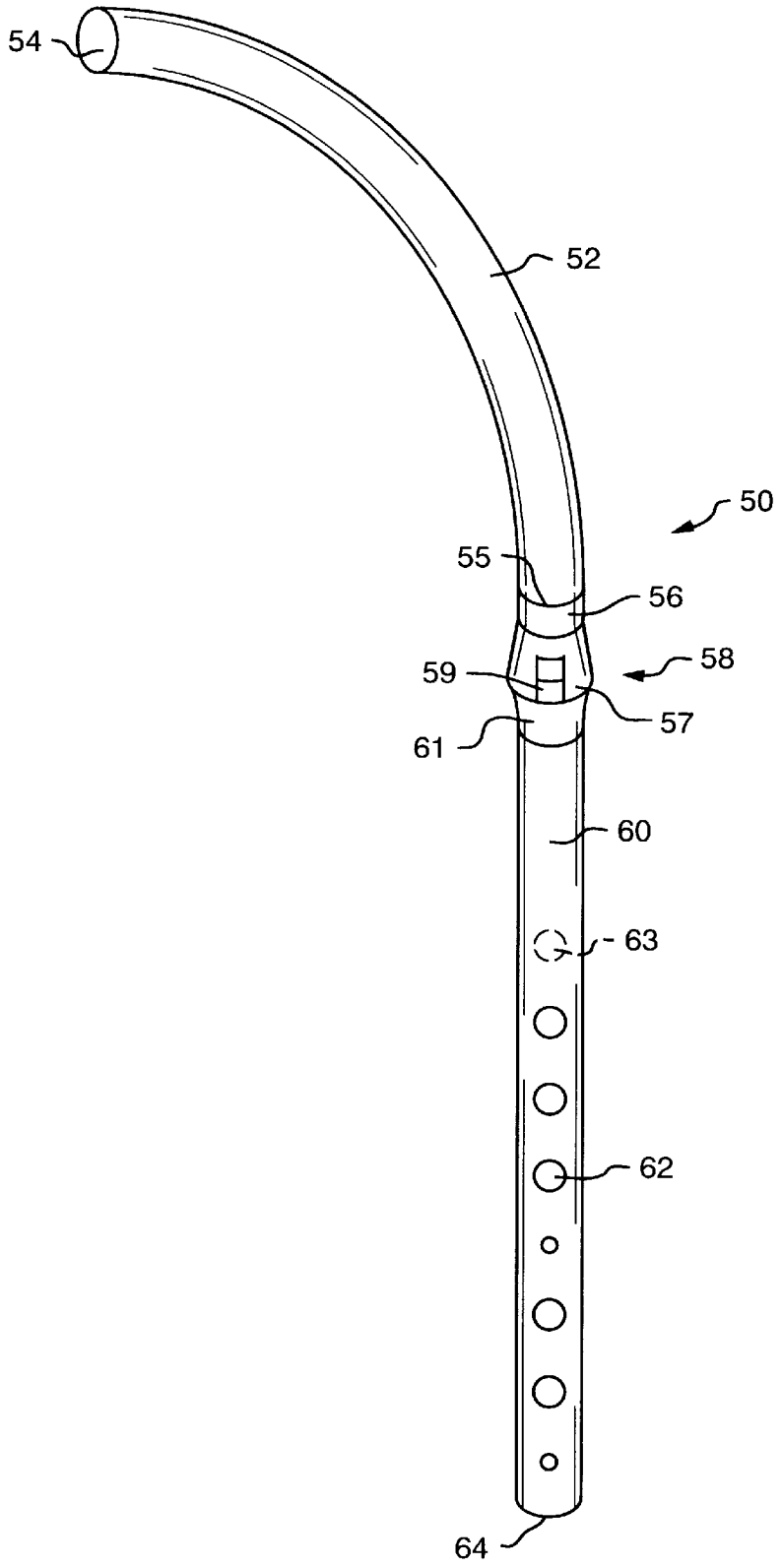
FIG. 3 is a front isometric view of the preferred practice chanter of the present invention with hidden lines included to show the location of the back hole.

Referring now to FIG. 3, an isometric view of the practice chanter of the present invention is shown. The practice chanter 50 of the present invention comprises a flexible airtube 52, a fipple head 58 attached to the flexible airtube 52, and a substantially rigid whistle tube 60, having a plurality of holes 62 of predetermined diameters and disposed at predetermined locations, attached to the fipple head 58.

Flexible airtube 52 is preferably a flexible substantially cylindrical tube having an open first end 54 in which a player blows air and a second end 56 dimensioned to fit over an air inlet portion 55 of the fipple head 58. Flexible airtube 52 may be secured to fipple head 58 through a interference fit, mechanical fasteners such as hose type clamps, or by chemical bonding through the use of a suitable bonding agent such as an epoxy, glue or similar fastening resin. The flexible airtube 52 is flexible and is dimensioned to allow a player to easily raise the bottom of the practice chanter 50 off of the player's leg, while in a sitting position, to play the bassist note in the closed position and to allow the player to easily play in both the closed position and the open position. In the preferred embodiment, flexible airtube 52 is made of a vinyl tubing having an inner diameter of 0.5 inches, a wall thickness of 0.0625 inches, and a length of 13.5 inches, measured along an arc of the flexible airtube. Clear vinyl is preferred as it provides the player with the ability to monitor the amount of moisture that is built up within the flexible airtube and empty the moisture when it begins to interfere with the operation of the practice chanter. However, flexible airtubes made from different tubing having differing dimensions and/or degrees of transparency or translucency may be used to obtain similar results.

Fipple head 58 may take many forms provided that it will produce two clean octaves when mounted on a whistle tube and fingered as an Uilleann Pipe chanter. Though any number of commercially available fipple heads meet this criteria, it is preferred that fipple heads produced for use with tin whistles by either the Generation Company of Oswestry, England, or the Susato Company of Brasstown, N.C., may be utilized. As shown in FIG. 3, fipple head 58 includes an air inlet portion 55 in fluid communication with the second end 56 of the flexible airtube 52, a hollowed body 57 in which a sharp edged hole 59 is disposed, and a whistle tube portion 61 attached to the whistle tube 60. Sharp edged hole 59 in hollowed body 57 is not covered by the flexible airtube 52, but rather is exposed to allow air to pass from the inside of the hollowed body 57 and against the sharp edged hole 59. As is the nature of all fipple flutes, the vibration of this air by the sharp edge of the hole produces a sound of a given harmonic, dependent upon the shape of the body and the intensity of the airstream through the head. The pitch of the sound may then be varied by varying the length of the tube containing the vibrating air column. Thus, the desired pitch is achieved by covering and uncovering predetermined air holes along the tube, lengthening or shortening the effective length of the tube.

Whistle tube 60 is sealably attached in fluid communication with whistle tube portion 61 of fipple head 58 and comprises a plurality of holes 62 disposed at predetermined locations along the front of its length and a back hole 63 disposed at predetermined location along the back of its length. These locations correspond to locations of holes in the bagpipe chanter for which practice is desired. In addition, each of the holes 62 is of a predetermined diameter such that notes produced by said practice chanter correspond to notes produced by a predetermined bagpipe chanter. The whistle tube 60 includes an open end 64 that may be sealed against a player's leg or left open depending upon the note to be played and whether the player is playing in an open or closed position.

Figure 4:
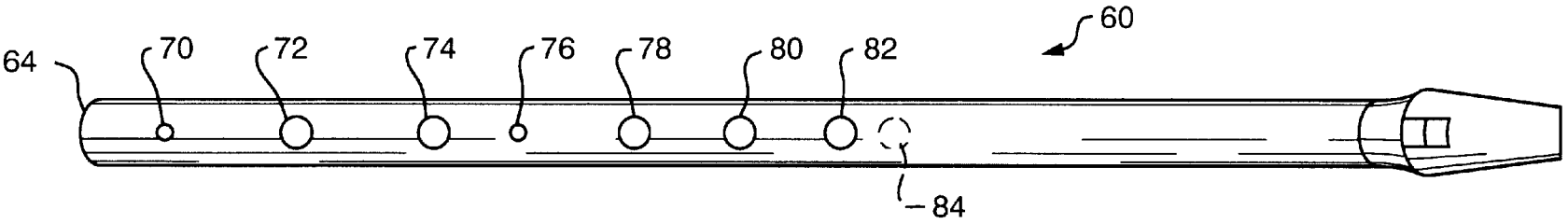
FIG. 4 is a view of a whistle tube for use with the practice chanter of the present invention showing preferred hole locations and sizes.

Referring now to FIG. 4, the preferred whistle tube of the present invention is shown. It should be noted that hole distances and hole sizes may be altered to provide a practice chanter that plays in a different key or at a different temperament. This is accomplished by altering the length of the tube and the placement of the holes. If tubes of a given same interior diameter are used, then lengthening the tube will lower the fundamental pitch that tube will have and will lower in frequency the key will be that that tube can play. In tubes of the same length having different diameters, increasing the diameter will generally produce a higher pitch while decreasing the diameter will generally lower the pitch.

Temperament is the musical distance between notes and thus changes in temperament are effected by moving notes farther apart or closer. In the practice chanter of the present invention, such a change may be accomplished either by moving the finger holes on the tube closer to the fipple head, raising the note's pitch, or moving them farther away from the fipple head, lowering the note's pitch. In addition, the pitch may be altered by increasing or decreasing the diameter of the holes in the whistle tube, with a larger diameter resulting in a higher pitch and a smaller diameter resulting in a lower pitch. In this manner, the practice chanter may be adapted for use as a practice instrument for other keys or for other types and styles of bagpipes.

Though it is understood that the fipple head and holes may be altered to obtain a practice chanter that will play in a given key or temperament, the preferred embodiment includes holes 62 spaced and sized to obtain a practice chanter for Uilleann Pipes that plays in a B flat key. Referring to FIG. 4, the preferred measurements for a B flat key chanter are shown from the open end 64 of the whistle tube 60 to the center of each hole.

TABLE 1

Hole locations and sizes for B flat key chanter

| HOLE | DISTANCE (IN.) | DISTANCE (CM) | DIAMETER (IN) | DIAMETER (MM) |
|---|---|---|---|---|
| 70 | 3/4 | 1.9 | 1/16 | 2 |
| 72 | 1 31/32 | 5.0 | 5/16 | 8 |
| 74 | 3 9/32 | 8.3 | 11/32 | 8.5 |
| 76 | 4 1/8 | 10.3 | 3/16 | 5 |
| 78 | 5 1/4 | 13.3 | 9/32 | 7 |
| 80 | 6 18/64 | 16.0 | 9/32 | 7 |
| 82 | 7 19/64 | 18.5 | 1/4 | 6.8 |
| 84 | 7 27/32 | 19.97 | 9/32 | 7 |

In an alternative embodiment of the invention, the holes 62 are spaced and sized to in an A key practice chanter. Referring again to FIG. 4, the preferred measurements for a B flat key chanter are shown from the open end 64 of the whistle tube 60 to the center of each hole.

TABLE 2

Hole locations and sizes for A key chanter

| HOLE | DISTANCE (IN.) | DISTANCE (CM) | DIAMETER (IN) | DIAMETER (MM) |
|---|---|---|---|---|
| 70 | 11/16 | 1.7 | 5/32 | 4 |
| 72 | 1 7/8 | 4.8 | 5/16 | 8 |
| 74 | 3 1/16 | 7.75 | 5/16 w × 3/8 l | 8 w × 9.5 l |
| 76 | 4 1/4 | 10.75 | 7/32 | 5.5 |
| 78 | 5 3/8 | 13.6 | 17/64 | 7 |
| 80 | 6 15/32 | 16.4 | 17/64 | 7 |
| 82 | 7 1/2 | 19.05 | 1/4 | 6 |
| 84 | 8 5/32 | 20.65 | 17/64 | 7 |

As shown in Table 2, in the A key embodiment of the practice chanter, hole 74 is not round but rather is an elliptical hole having a width dimension and a length dimension. All other holes are round, as was the case with the B flat key embodiment.

Figure 5:
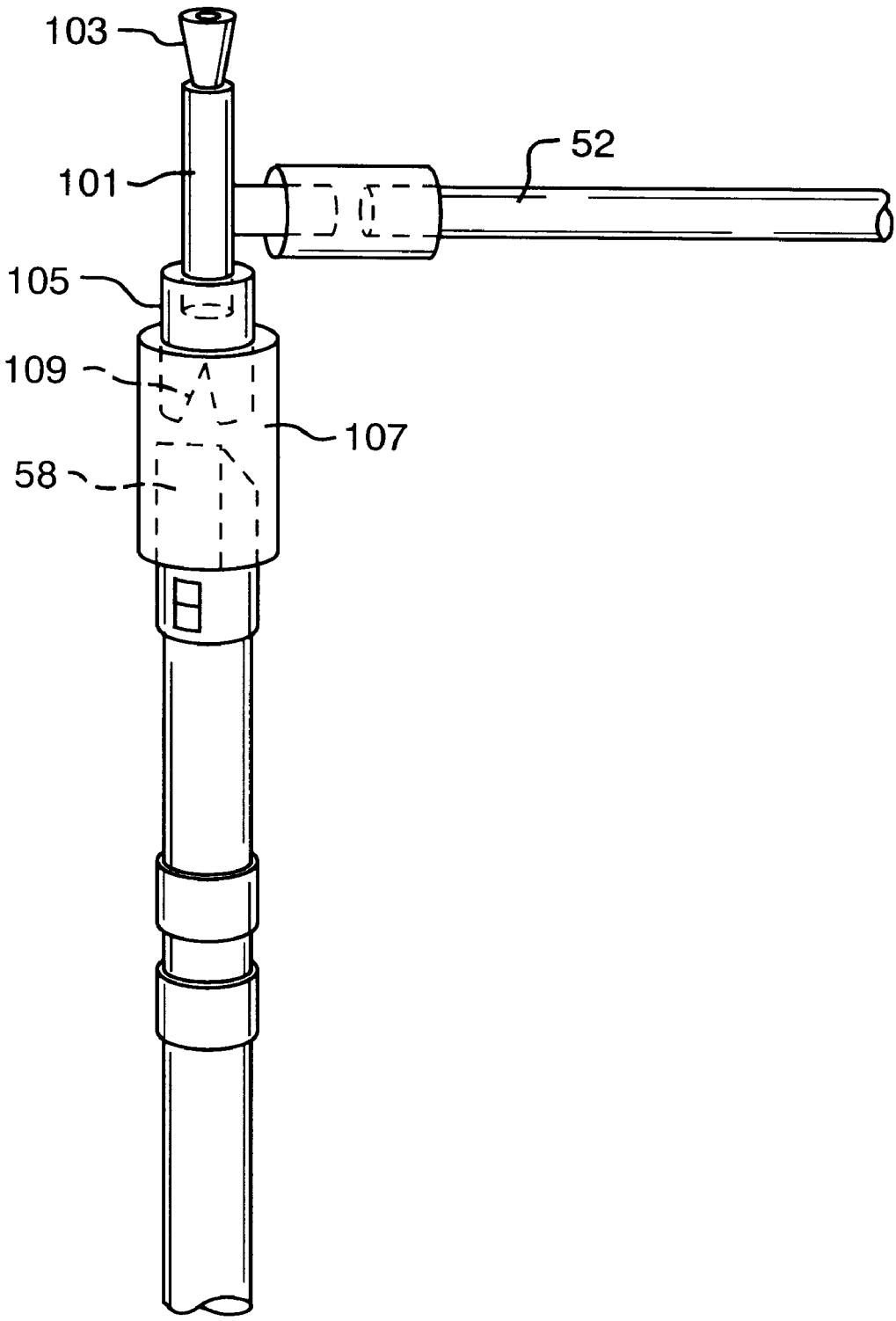
FIG. 5 is an isometric view of an alternative embodiment of the practice chanter of the present invention having a connector between the fipple head and flexible airtube.

Referring now to FIG. 5, an alternate embodiment of the practice chanter of the present invention is shown. In this embodiment, the flexible airtube 52 is not attached directly to the fipple head 58, but rather is attached to a connector 101 to allow the flexible airtube 52 to extend at an angle from the fipple head 58. As shown in FIG. 5, this connector 101 is "T" shaped and includes a stop 103 to close off the open end of the connector 101. However, in other embodiments, connector 101 may be an elbow type connector dimensioned to dispose the flexible airtube 52 at a variety of angles from the fipple head 58.

Figure 6:
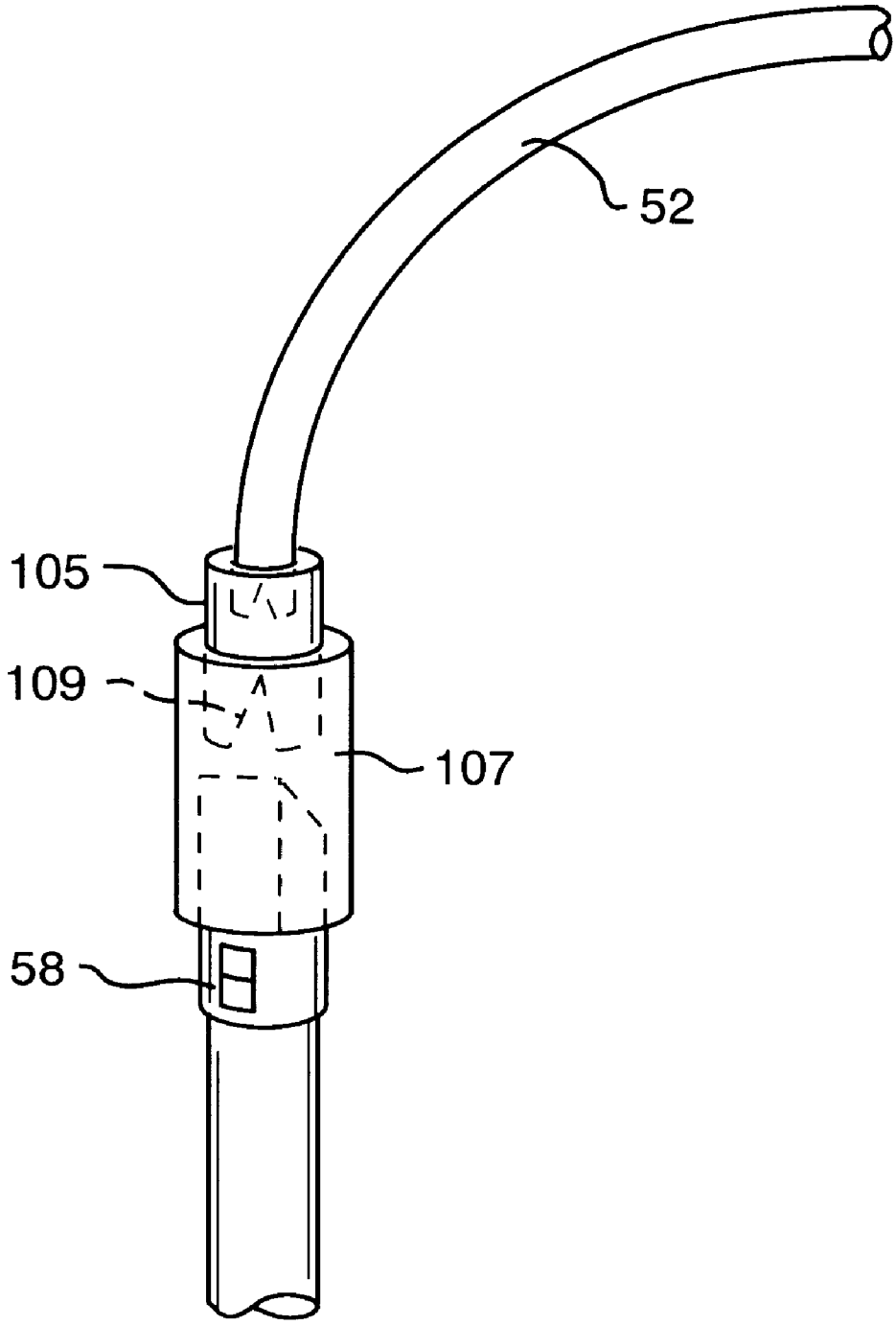
FIG. 6 is an isometric view of an alternative embodiment of the present invention in which the junction tube is connected directly to the flexible airtube.

The embodiment of FIG. 5 also includes a notched junction tube 105 that joins the connector 101 to a fipple head tube 107. Junction tube 105 includes a v shaped notch cut 109 that acts to direct the air into the airway of the ripple head 58, enhancing performance of the chanter at the low pressures related to the lowest tones produced by the chanter. Though shown only with connector 101, it is recognized that junction tube 105 may also be connected directly to the flexible airtube 52 of the basic embodiment, as shown in FIG. 6, or to a drone tube, as described in connection with FIG. 7, to achieve similar results.

Figure 7:
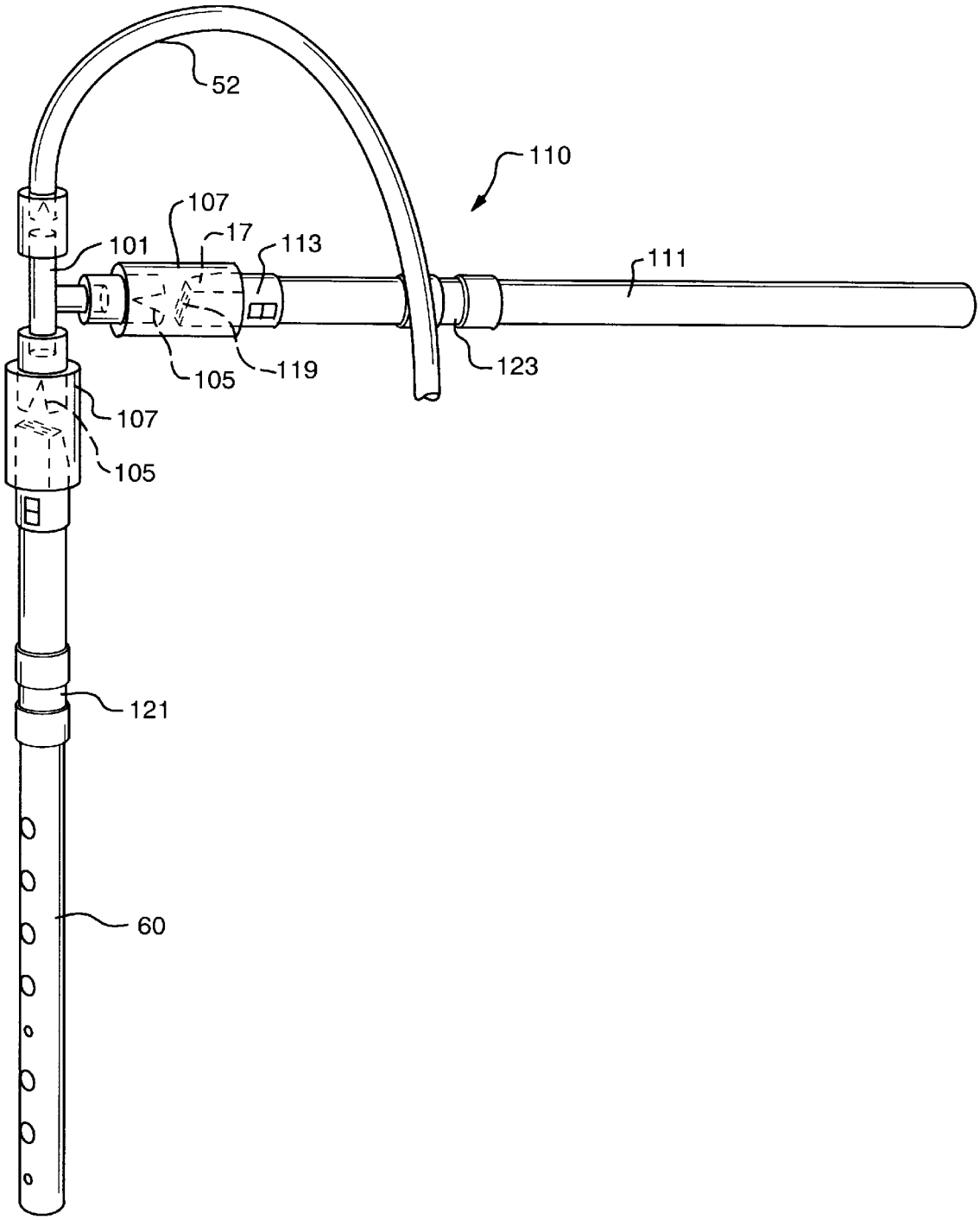
FIG. 7 is an isometric view of an alternative embodiment of the present invention utilizing a drone tube attached to a connector.

Referring now to FIG. 7, another alternate embodiment of the practice chanter is shown. In this embodiment, connector 101 is attached to both flexible airtube 52 and a drone 110 to produce a fuller sound, more closely resembling the sound of a full set of Uilleann Pipes. Drone 110 includes a drone tube 111 and a second ripple head 113 that is attached to connector 101 by a second notched junction tube 105 and ripple head tube 107. Drone tube 111 is a tube of predetermined length and diameter having no holes drilled along its length. In this embodiment, both the drone tube 111 and whistle tube 60 include adjustable slides 121, 123 that allow each to be lengthened or shortened to tune each independently. In some embodiments of the present invention, a gum adhesive 117 is utilized as an air restrictor in the second fipple head 113 to reduce the amount of air entering into the drone tube 111 and allowing the drone tube 111 to switch pitch to a higher octave as the practice chanter switches pitch into the second octave. This is accomplished by covering a predetermined percentage of the air inlet 119 of the second fipple head 113, preferably about fifty percent.

Figure 8:
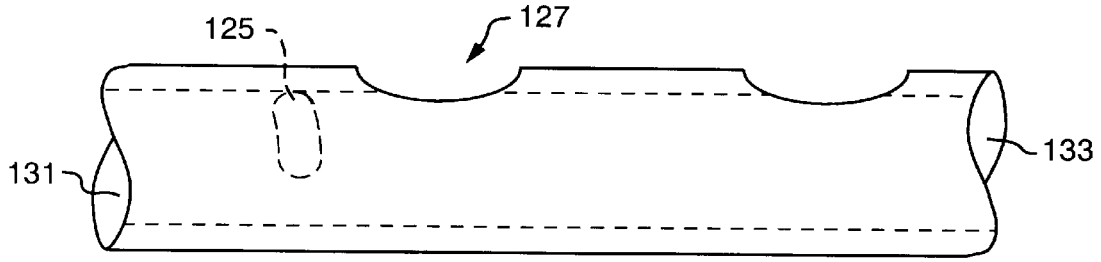
FIG. 8 is a plan view of one embodiment of the present invention in which an adhesive gum is utilized to alter the pitch of a predetermined note.

Referring now to FIG. 8, the preferred embodiment of an air volume reduction system utilized with the practice chanter of the present invention is shown. For many years, players have placed tape across finger holes to make them flatter or sharper, depending upon whether it is placed upon the top or bottom of the holes respectively. In some embodiments of the present invention, a gum adhesive is used as an air volume reducer in the whistle chanter to change the pitch of a predetermined note. As shown in FIG. 8, the upwind end and downwind end of the tube are denoted as 131 and 133 respectively. With respect to the D note, the gum 125 is attached and semi-flattened to the inner surface of the whistle tube just upwind of the finger hole 127 for the D note, making the first octave D note flatter than without the reducer. However, it is also recognized that this technique may be utilized in other embodiments to alter the pitch of other notes.

Figure 9:
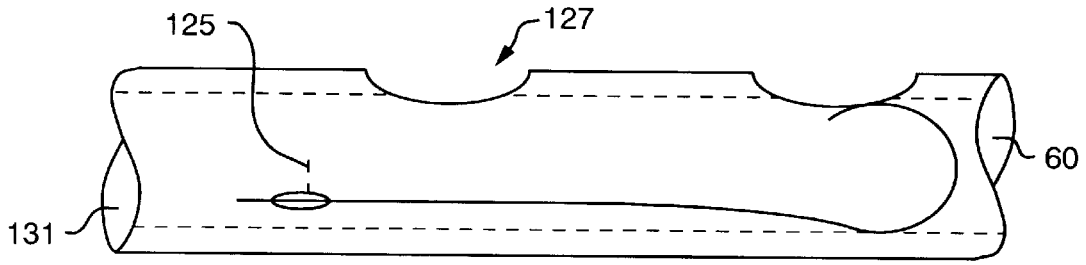
FIG. 9 is a plan view of another embodiment of the present invention in which a wire mounted adhesive gum is utilized to alter the pitch of a predetermined note.

Referring now to FIG. 9, an alternative embodiment of the air volume reduction system is shown. In this embodiment, the pitch is altered by disposing the gum 125 on a wire 140 and inserting the wire 140 into the bottom of the whistle tube 60 such that the gum 125 is disposed a predetermined distance upwind of the desired finger hole 127. The wire 140 is preferably curved about itself for a short distance in to the bottom of the whistle tube 60 such that the wire 140 exerts spring-like pressure against the sides of the whistle tube 60, effectively preventing the gum 125 from moving out of its predetermined position relative to the finger hole 127.

Finally, it is contemplated that the practice chanter of the present invention may be adapted for attachment to an airbag and bellows, as described with reference to the prior art Uilleann Pipes, to allow a player to practice both fingering techniques as well as bag and bellows operational techniques. Such an adaptation would include a shortening of the tube such that it would attach to the bag and fipple head to allow the chanter to be held in the same manner as described above. In these embodiments, up to three drones and up to three keyed regulators may be utilized, all using fipple heads instead of reeds to generate the sound.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A practice bagpipe chanter for simulating a predetermined bagpipe chanter, said practice bagpipe chanter comprising:

a flexible substantially cylindrical airtube having a first end and a second end;

a fipple head attached to said second end of said flexible airtube; and a substantially rigid whistle tube attached to said fipple head, wherein said whistle tube comprises a plurality of holes disposed at predetermined locations along a length of said whistle tube corresponding to locations of holes in said predetermined bagpipe chanter, and wherein each of said plurality of holes is of a predetermined diameter such that notes produced by said practice chanter correspond to notes produced by said predetermined bagpipe chanter.

2. The practice bagpipe chanter as claimed in claim 1 wherein said plurality of holes are disposed at predetermined locations along a length of said whistle tube corresponding to locations of holes in an Uilleann Pipe chanter, and wherein said diameter of each of said holes is such that said notes produced by said practice chanter utilizing a given fingering pattern correspond to notes produced by said Uilleann Pipe chanter utilizing the same fingering pattern.

3. The practice bagpipe chanter as claimed in claim 2 wherein each of said holes is of a predetermined diameter and is disposed at a predetermined location such that said practice chanter plays in a B flat key.

4. The practice bagpipe chanter as claimed in claim 2 wherein each of said holes is of a predetermined diameter and is disposed at a predetermined location such that said practice chanter plays in an A key.

5. The practice bagpipe chanter as claimed in claim 1 wherein said flexible airtube is manufactured from a clear vinyl tubing.

6. The practice bagpipe chanter as claimed in claim 1 wherein said flexible airtube is of a material having sufficient flexibility to allow a player to lower and raise an end of said whistle tube to and from a leg of a seated player such that said player may play said practice chanter in both a closed position and an open position.

7. The practice bagpipe chanter as claimed in claim 1 further comprising a connector for connecting said flexible airtube at a predetermined angle relative to said fipple head.

8. The practice bagpipe chanter as claimed in claim 7 wherein said connector is a T shaped connector and further comprises a plug for sealing an open end of said T shaped connector.

9. The practice bagpipe chanter as claimed in claim 8 further comprising a drone attached to said open end of said T shaped connector.

10. The practice bagpipe chanter as claimed in claim 9 wherein said drone comprises a second fipple head and a drone tube.

11. The practice bagpipe chanter as claimed in claim 10 wherein said second fipple head comprises an air inlet and wherein said air inlet is partially closed by an adhesive gum.

12. The practice bagpipe chanter as claimed in claim 10 wherein said drone further comprises an adjustable slide.

13. The practice bagpipe chanter as claimed in claim 7 further comprising at least one notched junction tube attached to said connector.

14. The practice bagpipe chanter as claimed in claim 1 further comprising at least one notched junction tube for attaching said flexible airtube to said fipple head.

15. The practice bagpipe chanter as claimed in claim 1 further comprising an air restrictor disposed at a predetermined location within said whistle tube for altering a pitch of a predetermined note.

16. The practice bagpipe chanter as claimed in claim 14 wherein said air restrictor comprises an adhesive gum.

17. The practice bagpipe chanter as claimed in claim 1 wherein said whistle tube further comprises an adjustable slide.

* * * * *

UNITED STATES PATENT AND TRADEMARK OFFICE

CERTIFICATE OF CORRECTION

PATENT NO. : 6,031,168
DATED : February 29, 2000
INVENTOR(S) : Edward A. Damm

It is certified that error appears in the above-identified patent and that said Letters Patent is hereby corrected as shown below:

Title page,
Item [56], the attorneys' should be Michael J. Persson; William B. Ritchie, rather than Michael J. Pebson; William B. Ritchie.
The illustrative figure should be deleted to be replaced with the attached title page.

Drawing sheet, consisting of Fig. 7, should be deleted to be replaced with the Drawing sheet, consisting of Fig. 7, as shown on the attached page.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*

US006031168A

United States Patent [19]

Damm

[11] Patent Number: 6,031,168

[45] Date of Patent: Feb. 29, 2000

[54] PRACTICE BAGPIPE CHANTER

[76] Inventor: Edward A. Damm, 24 Ledgelawn Ave., Bar Harbor, Me. 04609

[21] Appl. No.: 09/207,308

[22] Filed: Dec. 8, 1998

[51] Int. Cl.[7] ..... G10D 7/00

[52] U.S. Cl. ..... 84/380 B; 84/380 R; 84/465

[58] Field of Search ..... 84/380 A, 380 B, 84/380 R, 381, 380 C, 465, 453; D17/10

[56] References Cited

U.S. PATENT DOCUMENTS

| | | | |
|---|---|---|---|
| 152,554 | 6/1874 | Gade | 84/380 R |
| D. 248,187 | 6/1978 | Roe | D17/2 |
| 1,069,200 | 8/1913 | Starck | 84/380 B |
| 1,498,280 | 6/1924 | Izold | 84/380 R |
| 2,233,507 | 3/1941 | Adamson | 84/380 B |
| 2,509,429 | 5/1950 | Grow | 84/380 B |
| 2,737,074 | 3/1956 | Magnus | 84/375 |
| 3,154,995 | 11/1964 | Kuhn | 84/381 |
| 3,438,298 | 4/1969 | Thompson | 84/380 R |
| 3,756,112 | 9/1973 | Adams | 84/380 B |
| 3,988,956 | 11/1976 | Moeck | 84/380 R |
| 4,104,948 | 8/1978 | Young | 84/380 C |
| 4,306,484 | 12/1981 | Toyama | 84/380 R |
| 4,378,724 | 4/1983 | Lamart | 84/465 |
| 4,539,888 | 9/1985 | Whelan | 84/380 R |

FOREIGN PATENT DOCUMENTS

| | | |
|---|---|---|
| 16300 | 7/1916 | United Kingdom . |
| 1582404 | 1/1981 | United Kingdom . |

OTHER PUBLICATIONS

Baines, A.: "Woodwind Instruments and their History.," (2nd edition), William Clowes and Sons, LTD, London, 1962, p. 200.

Encyclopedia Britannica, (15th edition), Encyclopedia Britannica, Inc., 1994, p. 795.

Dearling, R. (ed): "The Illustrated Encyclopedia of Musical Instruments." Carlton Books LTD, Dubai, 1996, pp. 185 and 187.

*Primary Examiner*—David Martin
*Assistant Examiner*—Wesley Scott Ashton
*Attorney, Agent, or Firm*—Michael J. Pebson; William B. Ritchie

[57] ABSTRACT

The present invention is a practice chanter for simulating a bagpipe chanter. In its most basic form, the practice chanter of the present invention includes a flexible airtube, a fipple head attached to the flexible airtube, and a rigid whistle tube attached to the fipple head. In this basic embodiment, the whistle tube includes a plurality of holes disposed at predetermined locations along the length of the whistle tube corresponding to locations of holes in the predetermined bagpipe chanter, with each of the holes having a predetermined diameter such that the key and pitch of notes produced by the practice chanter correspond to notes produced by the bagpipe chanter. In the preferred embodiment, the practice chanter is dimensioned to simulate an Uilleann Pipe chanter. In this embodiment, the whistle tube holes are disposed in the same relation to one another as with an Uilleann Pipe chanter and each hole is of a predetermined diameter that allows notes played by the practice chanter with a given fingering pattern to correspond to notes produced by the Uilleann Pipe chanter played with the same fingering pattern.

17 Claims, 8 Drawing Sheets

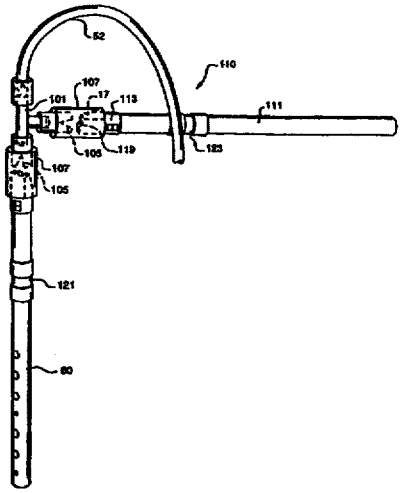

UNITED STATES PATENT AND TRADEMARK OFFICE

CERTIFICATE OF CORRECTION

PATENT NO. : 6,031,168
DATED : February 29, 2000
INVENTOR(S) : Edward A. Damm

It is certified that error appears in the above-identified patent and that said Letters Patent is hereby corrected as shown below:

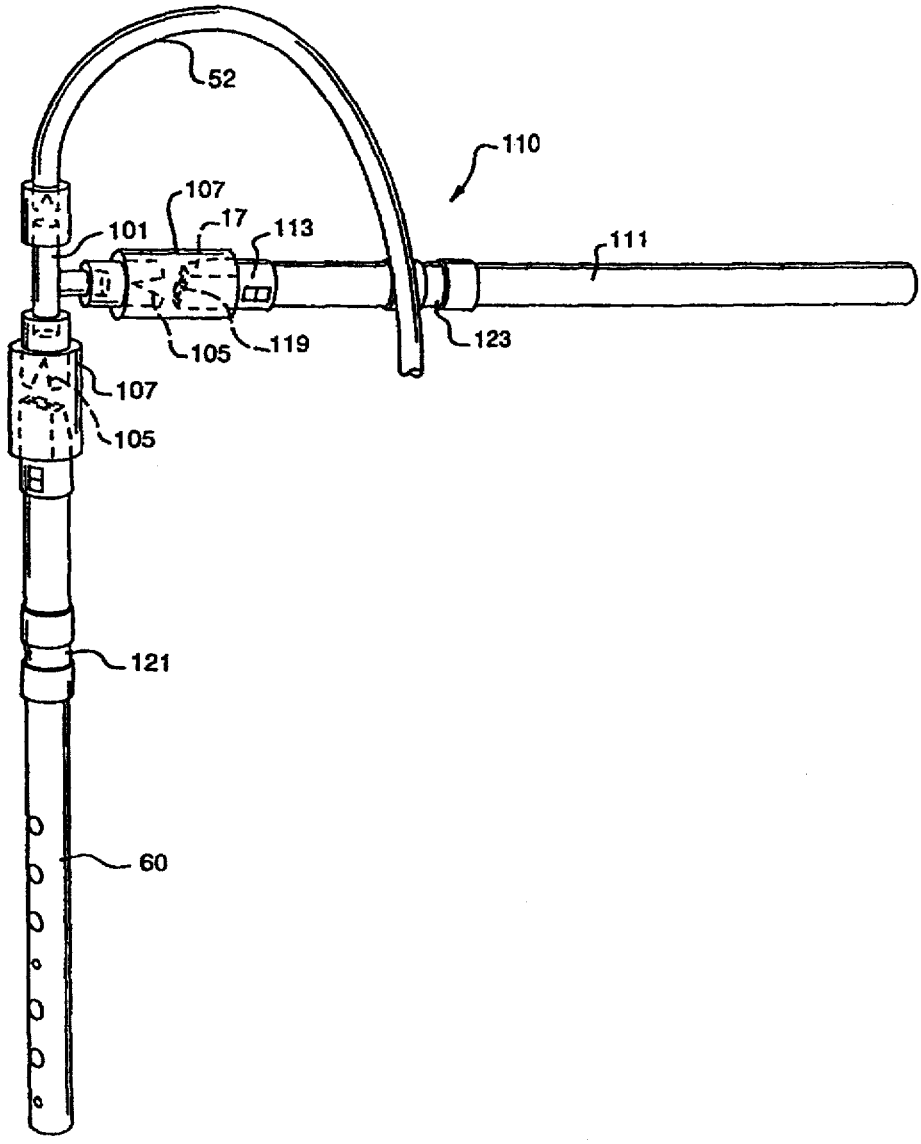

7/8